United States Patent [19]

Telford et al.

[11] Patent Number: 4,545,567

[45] Date of Patent: Oct. 8, 1985

[54] WINCH POWER TRANSMISSION

[75] Inventors: Thomas M. Telford, Gladstone; James W. Haase, Milwaukie, both of Oreg.

[73] Assignee: Warn Industries, Inc., Kent, Wash.

[21] Appl. No.: 602,160

[22] Filed: Apr. 19, 1984

[51] Int. Cl.[4] ..... B66D 1/22; B66D 5/20

[52] U.S. Cl. ..... 254/344; 188/337; 254/345; 254/347; 254/378

[58] Field of Search ..... 254/344, 345, 347, 350, 254/351, 368, 378, 355, 356; 188/336, 343, 134; 192/18 R, 76, 78, 93 A, 93 C

[56] References Cited

U.S. PATENT DOCUMENTS

| | | | |
|---|---|---|---|
| 1,285,663 | 11/1918 | Fouse | 254/347 X |
| 1,911,461 | 5/1933 | Musselman | 188/336 X |
| 2,197,819 | 4/1940 | Vickers | 188/134 |
| 2,423,070 | 6/1947 | Sayles | 188/336 X |
| 2,891,767 | 6/1959 | Armington, Jr. | 254/344 |
| 3,055,237 | 9/1962 | Magnuson | 254/344 X |
| 3,071,349 | 1/1963 | Glaze | 254/344 |
| 3,101,138 | 8/1963 | Wochner | 254/344 X |
| 3,107,899 | 10/1963 | Henneman | 254/347 |
| 3,219,154 | 11/1965 | Schenck et al. | 188/134 |
| 3,319,492 | 5/1967 | Magnuson | 254/344 X |
| 3,627,087 | 12/1971 | Eskridge | 192/8 R |
| 3,630,329 | 12/1971 | Nelson | 188/134 X |
| 4,004,780 | 1/1977 | Kuzarov | 254/345 |
| 4,118,013 | 10/1978 | Christison et al. | 254/344 |
| 4,185,520 | 1/1980 | Henneman et al. | 254/344 X |
| 4,227,680 | 10/1980 | Hrescak | 254/344 |
| 4,287,785 | 9/1981 | Hunt | 188/343 X |
| 4,344,587 | 8/1982 | Hildreth | 242/99 X |
| 4,461,460 | 7/1984 | Telford | 254/344 |

*Primary Examiner*—Stuart S. Levy
*Assistant Examiner*—Joseph J. Hail, III
*Attorney, Agent, or Firm*—Graybeal & Cullom

[57] ABSTRACT

A winch is powered by a motor mounted at one end of a drum through a three-stage planetary drive train disposed adjacent the opposite end of the drum. The motor includes a first drive shaft which extends axially into the interior of the drum. The drive train includes a second drive shaft which extends axially into the interior of the drum toward the motor. A brake-clutch assembly is disposed within the interior of the drum and operably interconnects the first drive shaft and the second drive shaft. The brake-clutch assembly operates automatically in response to the direction of the torque being transmitted between the first drive shaft and the second drive shaft. In operation, the brake-clutch assembly permits the second drive shaft to rotate relative to and power the drum to reel in the load on the cable and then frictionally locks the second drive shaft to the inside diameter of the drum to hold the load on the cable when the motor is stopped. When the motor is operating in the reverse direction to reel out the load attached to the cable, the brake-clutch assembly will frictionally bear against the inside diameter of the drum if needed to control the rotational speed of the drum to prevent it from overrunning the motor.

10 Claims, 4 Drawing Figures

WINCH POWER TRANSMISSION

BACKGROUND OF THE INVENTION

1. Field of the Invention

The present invention relates to winches and more particularly to winches having a brake-clutch assembly which frictionally engages the inside of the winch drum. A typical use of the present winch is to mount it on the front or rear bumper of a motor vehicle where it may be utilized in any of the various known modes. The winch may also be used in various industrial applications.

2. Description of the Prior Art

Prior art winches typically include a cable winding drum which is rotatably driven by a reversible electric or hydraulic motor or other type of power device. A speed reducing drive train is interposed between the hydraulic or electrical motor and the drum in order to provide torque amplification and also to reduce the typically relatively high speed of the motor. A brake assembly is commonly operably interconnected to the drive train to prevent unwinding of the drum when the motor is stopped and a load is attached to the cable. When the winch is being operated to pay out the cable to lower a load, the brake prevents the drum from overrunning the motor, thus acting as a governor to limit the cable payout speed. An inherent characteristic of such winches is the generation of heat when the cable is loaded and the brake is applied to limit the rotational speed of the drum when lowering the load.

In one type of prior art winch, the brake is composed of a plurality of thin, alternating friction discs and steel discs with either the friction or steel discs splined to a portion of the winch which is stationary relative to the drum while the other discs are splined either directly or indirectly to the drum. Means are provided to squeeze the friction discs and steel discs together either to stop or to control the rotational speed of the drum. When the brake is in constant use, large amounts of heat are produced in the discs as they rub against each other. If the discs are heated to a high temperature, the friction material on the friction discs may become glazed and/or the discs may warp, thereby reducing the effectiveness of the brake. As a result, increased squeezing pressures must then be applied to the brake discs to control the speed of or to stop the drum, thereby generating even larger amounts of heat causing further damage to the brake discs. Examples of prior art winches using this type of brake are disclosed by Henneman U.S. Pat. Nos. 3,107,899; Magnuson 3,319,492; Eskridge 3,627,087; Christison et al 4,118,013; Henneman et al 4,185,520; and, Hrescak 4,227,680.

In another type of winch, a brake assembly is composed of a central disc or ring which is squeezed between a pair of circular or annular brake pads disposed on opposite sides of the central disc. Typically, either the disc or one of the pads is anti-rotationally connected to the housing or some other stationary portion of the winch while the opposite member is directly or indirectly coupled to the drum. Means are provided for pressing the brake pads against the center disc. Examples of this type of winch are disclosed by Armington U.S. Pat. Nos. 2,891,767 and Kuzarov 4,004,780. In Kuzarov U.S. Pat. No. 4,004,780, a plurality of friction buttons extend through axial holes formed in a central disc to engage against the brake pads. Although the central disc of the brake assemblies disclosed in these two patents are thicker than the friction discs of the brake assemblies of the previously described patents, the discs still do not have enough mass to dissipate the heat generated during constant braking of the drum at a rate fast enough to prevent a substantial rise in temperature in the brake assembly, leading to reduced effectiveness of the brake assembly.

In another type of winch, a frustoconically-shaped recess is formed in one flange of a winch drum to receive a correspondingly-shaped disc which is anti-rotationally mounted on a base plate. A linkage system is provided to axially shift the disc into engagement with the drum flange to control the rate at which cable is payed out from the drum. An example of this type of winch is disclosed in Fouse U.S. Pat. No. 1,285,663. A limitation of this type of winch is that the brake disc is not capable of modulating the rotational speed of the drum during powered pay out of the cable.

Accordingly, it is one object of the present invention to provide a winch having a brake-clutch assembly which frictionally bears against the inside diameter of the winch drum thereby utilizing a substantial mass and surface area of not only the winch drum, but also the steel cable wound around the drum to rapidly dissipate the heat generated during braking, especially when operating the winch under power to pay out or lower a substantial load. It is also an object of the present invention to provide a winch having sufficient gear reduction to provide the necessary torque amplification to minimize the required horsepower of the motor while also minimizing the overall size of the winch.

The prior art also includes the winch shown in copending Telford Serial No. 406,778 filed Aug. 10, 1982 entitled "Winch" now U.S. Pat. No. 4,461,460. That winch construction is generally satisfactory, however two problems have been noted during its production. The first problem is that nicks or burrs on the outside edge of the clutching double ring gear 158 tend to prevent ring gear 158 from sliding longitudinally as it should when actuating lever 164 is rotated. The second problem is that ring gear 158 is relatively long and thus any lubricant which may be between the spinning ring gear 158 and the stationary end housing 127 tends to act as a viscous clutch thereby causing excessive drag during free spool cable pull out.

Accordingly, it is another object of the present invention to provide a winch construction embodying a clutching ring gear which does not slide longitudinally and which is not subject to excessive viscous clutch drag from the lubricant.

A production version of the winch shown in Telford Ser. No. 406,778, now U.S. Pat. No. 4,461,460, utilizes a permanent magnet-type of electric motor the shaft of which, when the electrical current to the motor is switched off, has inherently a high resistance to rotation. If the motor is switched off while that winch is operating to reel in a load supported by the cable, the inherent high resistance to rotation of the motor shaft holds the drive cam member 72 which in turn causes the cam follower 74 to ramp up the cam surface 94 which in turn causes the brake-clutch assembly 24 to automatically frictionally lock the drum spool to hold the load by preventing reverse rotation of the drum. Thus, the actuator assembly 68 in that winch utilizes the high resistance to rotation of the switched off permanent magnet motor shaft in order to lock the drum.

Accordingly, it is another object of the present invention to provide a brake-clutch assembly for a winch which does not require the high resistance to rotation provided inherently by a permanent magnet-type of motor. Thus, it is sometimes preferred to employ a series-wound type electric motor in a winch and such motors do not possess a high resistance to rotation when the electric current is switched off. Hence, one of the advantages of the present invention is that the brake-clutch assembly provides excellent locking of the drum in a winch with a series-wound motor.

SUMMARY OF THE INVENTION

The winch of the present invention includes a hollow cable winding drum rotatably mounted on a pair of upright support structures for rotation about a longitudinal axis. A reversible motor is mounted on one of the support structures to extend axially from the adjacent end of the drum. The motor includes a first drive shaft extending axially within the hollow drum.

A power transmitting gear train is operably connected to the drum and disposed longitudinally of the opposite, second end of the drum. The gear train includes a second drive shaft extending axially within the hollow drum toward the first end of the drum.

A brake-clutch assembly is disposed within the drum and operably interconnects the first drive shaft with the second drive shaft. The brake-clutch assembly includes a brake assembly automatically frictionally engageable directly against and disengageable from the inside of the hollow drum in response to the direction of the torque load transmitted between the first drive shaft and the second drive shaft. A first overrunning clutch is disposed between the first drive shaft and the brake assembly to permit relative rotation between the first drive shaft and the brake assembly in a first direction but preventing relative rotation between the first drive shaft and the brake assembly in the opposite direction. A second overrunning clutch is disposed between the second drive shaft and the brake assembly to permit relative rotation between the second drive shaft and the brake assembly in the first direction but preventing relative rotation between the second drive shaft and the brake assembly in the opposite direction.

The brake assembly includes a first friction ring assembly having a frustoconically-shaped mandrel coupled to the first overrunning clutch, a first correspondingly-shaped frustoconical expandable friction ring antirotationally coupled to the first mandrel, and a drive lug for antirotationally coupling the first friction ring to the first mandrel to prohibit relative rotation while allowing relative longitudinal movement between the first friction ring and the first mandrel.

The brake assembly also includes a second friction ring assembly having a second frustoconically-shaped mandrel coupled to the second overrunning clutch, a second correspondingly-shaped frustoconical expandable friction ring antirotationally coupled to the second mandrel, and a drive lug for antirotationally coupling the second friction ring to the second mandrel to prohibit relative rotation while allowing relative longitudinal movement between the second friction ring and the second mandrel.

The brake assembly also includes an actuator assembly responsive to the direction of the torque acting on the first and second drive shafts for expanding the first and second friction rings against the inside diameter of the hollow drum and for contracting the first and second friction rings away from the inside diameter of the hollow drum depending on the direction of the torque load transmitted between the first and second drive shafts.

The actuator assembly includes a first cam member antirotationally coupled with the first drive shaft. The first cam member has an axially-facing cam surface. The actuator assembly also includes a second cam member antirotationally coupled with the second drive shaft. The second cam member has a corresponding axially-facing cam surface. The first cam member coacts with the second cam member as follows: (1) to move the first cam member axially toward the first friction ring assembly and to move the second cam member axially toward the second friction ring assembly when the torque load being transmitted between the first and second drive shafts is in the first direction to thereby urge the first and second friction rings against the first and second mandrels to expand the friction rings against the inside diameter of the hollow drum; and (2) to move the first cam member axially away from the first friction ring assembly and to move the second cam member axially away from the second friction ring assembly when the torque load being transmitted between the first and second drive shafts is in the opposite direction to allow the first and second friction rings to shift axially away from the first and second mandrels to thereby enable the friction rings to contract away from the inside diameter of the hollow drum.

BRIEF DESCRIPTION OF THE DRAWINGS

FIG. 1 is a rear view of the winch in the sense that the cable is reeled in and out from the opposite side of the winch.

DESCRIPTION OF THE PREFERRED EMBODIMENTS

Figure 1:
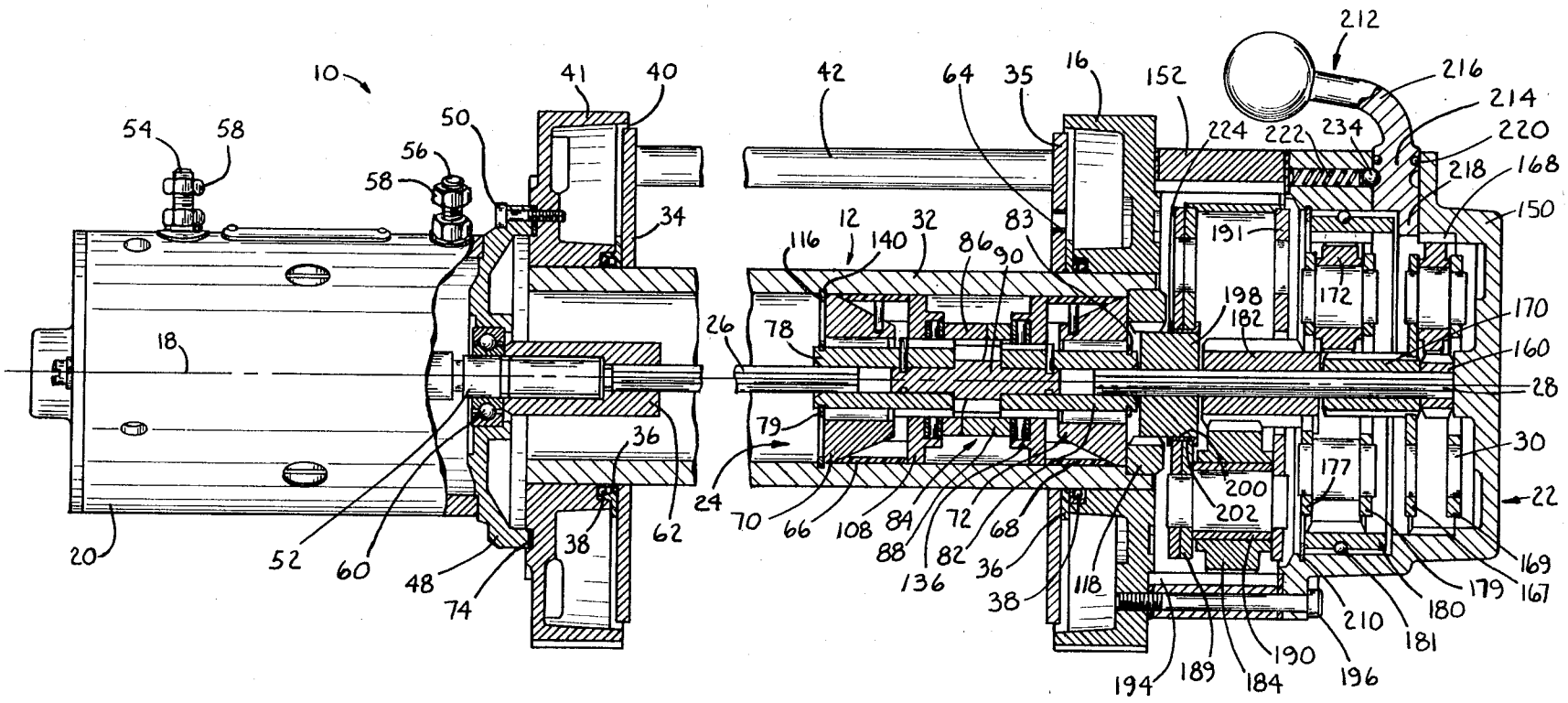
FIG. 1 is a side elevational view of a winch constructed according to the present invention. The central and right portions of the winch are shown in vertical cross-section to illustrate the internal components of the winch.

Referring initially to FIG. 1, a winch 10 constructed according to the best mode of the present invention includes a drum 12 supported by a pair of upright drum support structures 14 and 16 for rotation about a central longitudinal axis 18. A reversible motor 20 is mounted on motor-end drum support structure 14 located to the left or first side of drum 12, as viewed in FIG. 1, to extend longitudinally from the drum. Motor 20 is preferably a series wound-type of electric motor. A nonrotating gear train housing 22 is mounted on the drum support structure 16 located to the right or second side of drum 12 and extends longitudinally outwardly from the drum. Motor 20 drives a brake-clutch assembly 24 which is disposed within the interior of drum 12. An input drive shaft 26, which is disposed coaxially with longitudinal central axis 18, operably interconnects motor 20 with brake-clutch assembly 24. An output drive shaft 28, which is also disposed coaxially with axis 18, operably interconnects brake-clutch assembly 24 with gear train 30. Gear train 30 is coupled to the right end portion of drum 12 to rotate the drum at a substantially reduced speed relative to the rotational speed of motor 20.

Figure 3:
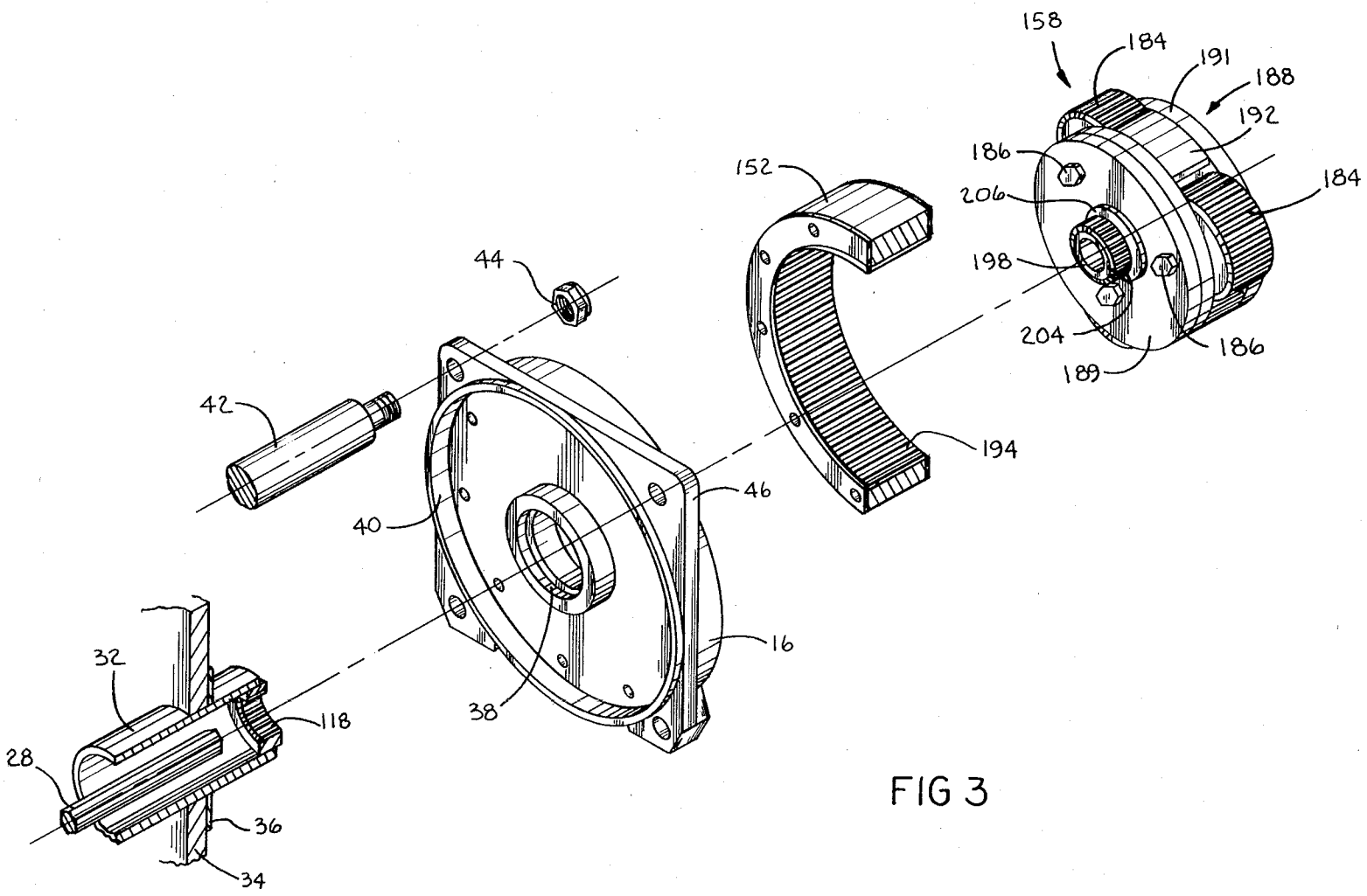
FIG. 3 is an isometric exploded view of a portion of the winch and the gear train taken from the left side of FIG. 1.

Drum 12 includes a hollow tubular spool 32 on which a conventional cable or wire rope (not shown) is typically wound. Flat annularly-shaped end flanges 34 and 35 are welded or otherwise secured to spool 32 a short distance inwardly from each end of the spool. A threaded aperture 64 through end flange 35 receives a capscrew (not shown) to attach the end of the cable to drum 12. Drum 12 rotates in a counterclockwise direction as viewed from the left in FIGS. 1 and 3 when winding in the cable. Thrust bushings 36 engage over the end portions of spool 32 disposed outwardly of flanges 34 and 35 to abut against the adjacent faces of the end flanges. Oil seals 38 fit within the central circular openings formed in drum support structures 14 and 16.

Preferably the motor-end drum support structure 14 and the gear train-end drum support structure 16 are constructed identically to each other in a generally rectangular shape. A shallow annularly-shaped recess 40 is formed in the inside face portions of support structures 14 and 16 for receiving spool end flanges 34 and 35. Four elongate tie rods 42 interconnect the upper and lower portions of support structures 14 and 16. Tie rods 42 extend through clearance openings formed in the upper and lower corner portions of support structures 14 and 16 to threadably engage with standard fasteners, such as nuts 44 (FIG. 3), which bear against the respective four corners of the support structures. Tie rods 42 serve to maintain the support structures 14 and 16 in proper spaced-apart relationship to support spool 32 without causing the spool to bind with the support structures when winch 10 is subjected to high loads during reel out or reel in of the cable. The bottom portions of support structures 14 and 16 may be secured to a mounting bracket (not shown) or other structure by any convenient means such as by use of mounting flanges 46 (FIG. 3) formed in the bases of the drum support structures 14 and 16.

Motor 20 is mounted on left support structure 14 through an intermediate annularly-shaped adapter plate 48 (FIG. 1). Adapter plate 48 is attached to left support structure 14 by a plurality of fasteners, such as bolts 50, extending through clearance openings spaced around the outer circumferential portion of the adapter plate to engage with aligned threaded openings formed in left support structure 14. Adapter plate 48 is concentrically aligned relative to the drum rotational axis 18. Circular gasket 74 is interposed between adapter plate 48 and support structure 14.

As illustrated in FIG. 1, motor 20 has an output shaft 52 journaled on a ball bearing 60 which fits within the central opening formed in adapter plate 48. Output shaft 52 extends within the interior of drum 12. Motor shaft adapter 62 fits over and is keyed to motor output shaft 52. A dowel pin (not shown) holds motor shaft adapter 62 on motor shaft 52. Input drive shaft 26, which is preferably hexagonal in shape, fits within a correspondingly-shaped axial bore in motor shaft adapter 62, and is thus antirotationally connected to motor shaft adapter 62.

Reversible motor 20 is illustrated in FIG. 1 as being electrically powered. Terminals 54 and 56 are located on motor 20 for interconnection with electrical lines (not shown) which provide electrical energy to the motor. Appropriate hardware, such as nuts 58, are threadably engaged on terminals 54 and 56 to retain standard electrical connectors (not shown). Rather than being electrically powered, motor 20 could alternatively be hydraulically powered or replaced with a power takeoff shaft or other type of power source.

Winch 10 includes a brake-clutch assembly 24 interconnected between input drive shaft 26 and output drive shaft 28. Output drive shaft 28 drives gear train 30 which in turn is rotationally coupled to drum 12. In general, brake-clutch assembly 24 permits rotation of output drive shaft 28 (in the counterclockwise direction as viewed from the left in FIG. 3) and drum 12 (in the same counterclockwise direction in FIG. 3) when the motor is operated to reel in the cable and then operates to automatically frictionally lock the output drive shaft 28 to the inside diameter of drum spool 32 in order to hold the load on the cable when motor 20 is switched off, thereby preventing reverse rotation of drum 12 (in the clockwise direction in FIG. 3) and dropping of the load. The brake-clutch assembly 24 also frictionally bears against the inside diameter of spool 32 when motor 20 is operated in the reverse direction to reel out a load attached to the cable when it is necessary to control the rotational speed of the drum 12 to prevent output drive shaft 28 from overrunning the motor 20. When winch 10 is reeling in a load, holding a load suspended on the cable, or reeling out a load on the cable at a controlled rate of speed, the relative torque load acting between motor 20 and output drive shaft 28 is in the same relative rotational direction.

Figure 2:
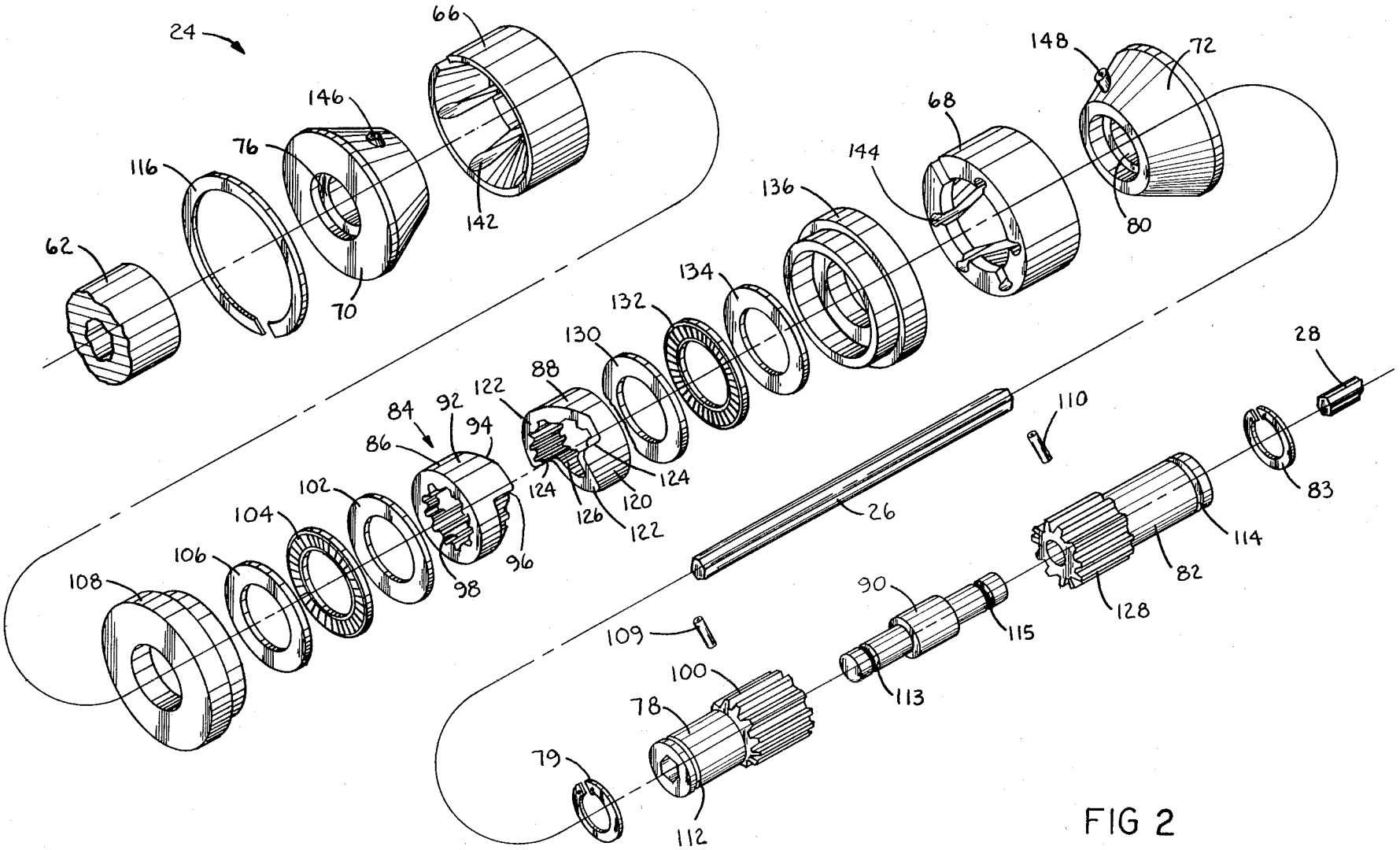
FIG. 2 is an isometric exploded view of the brake-clutch assembly of the present invention taken from the left side of FIG. 1.

Brake-clutch assembly 24 includes, as best shown in FIG. 2, left friction ring 66 and right friction ring 68, each having a radial split, each having an outside diameter which is nominally slightly smaller than the inside diameter of spool 32, and each having a frustoconically-shaped inside diameter. Friction rings 66 and 68 are mounted on and respectively engage with a pair of mandrels 70 and 72, each having a corresponding frustoconically-shaped outside diameter. An overrunning roller locking clutch 76 is held inside mandrel 70. When brake-clutch assembly 24 is assembled as in FIG. 1, overrunning clutch 76 is between mandrel 70 and input brake drive shaft 78 to permit input brake drive shaft 78 to rotate counterclockwise relative to mandrel 70 as viewed in FIG. 2, but not clockwise relative to mandrel 70. A retaining ring 79 fits in a circumferential groove 112 near the left end of input brake drive shaft 78 and keeps mandrel 70 in place. A second overrunning roller locking clutch 80 is held inside mandrel 72. When brake-clutch assembly 24 is assembled as in FIG. 1, overrunning clutch 80 is between mandrel 72 and output brake drive shaft 82 to permit output brake drive shaft 28 to rotate counterclockwise relative to mandrel 72 as viewed in FIG. 2, but not clockwise relative to mandrel 72. Another retaining ring 83 fits in a circumferential groove 114 near the right end of output brake drive shaft 82 and keeps mandrel 72 in place.

Brake-clutch assembly 24 also includes an actuator assembly 84 for pushing friction rings 66 and 68 against mandrels 70 and 72, respectively, thereby causing friction rings 66 and 68 to expand outwardly to frictionally bear against the inside diameter of spool 32. Actuator assembly 84 includes an input cam member 86 rotationally driven by motor 20. Input cam member 86 is splined to drive gear 100 which is the right end of input brake drive shaft 78. Input drive shaft 26, which is preferably hexagonal in shape, fits within a correspondingly-shaped axial bore in input brake drive shaft 78 and is thus antirotationally connected to input brake drive shaft 78.

Input cam member 86 contacts and coacts with output cam member 88. Output cam member 88 is splined to drive gear 128 which is the left end of output brake drive shaft 82. Output drive shaft 28, which is preferably hexagonal in shape, fits within a correspondingly-shaped axial bore in output brake drive shaft 82 and is thus antirotationally connected to output brake drive shaft 82.

Input brake drive shaft 78 and output brake drive shaft 82 rotate freely on the opposite ends, respectively, of pilot shaft 90 which is held in place between them by dowel pin 109 which fits radially into input brake drive shaft 78 and then into retaining groove 113 in pilot shaft 90 and by dowel pin 110 which fits radially into output brake drive shaft 82 and then into retaining groove 115 in pilot shaft 90, respectively.

Input cam member 86 of actuator assembly 84 includes a cylindrical wall 92 and two equally-sloping cam surfaces 94 terminating at longitudinal shoulders 96. An internal gear 98 is integrally formed in the bore to mesh with drive gear 100 on input brake drive shaft 78. Input cam member 86 abuts against thrust bushing 102 which abuts against thrust bearing 104 which in turn abuts against thrust bushing 106. Thrust bushing 106 bears against thrust plate 108. Thrust plate 108 bears against friction ring 66.

Output cam member 88 of actuator assembly 84 is identical in construction to input cam member 86. Cam member 88 has a cylindrical wall 120 and two equally-sloping cam surfaces 122 terminating at longitudinal shoulders 124. An internal gear 126 is integrally formed in the bore to mesh with drive gear 128 on output brake drive shaft 82. Cam member 88 abuts against thrust bushing 130 which abuts against thrust bearing 132 which in turn abuts against thrust bushing 134. Thrust bushing 134 bears against thrust plate 136. Thrust plate 136 bears against friction ring 68.

Friction rings 66 and 68 have an outside diameter which is nominally slightly smaller than the inside diameter of drum spool 32. The friction rings are formed with a slit, allowing the rings to expand in diameter when pushed or squeezed against mandrels 70 and 72. The inside diameters of friction rings 66 and 68 are formed in the shape of a frusto cone corresponding to and engageable with the associated frustoconical portions of mandrels 70 and 72. A plurality of longitudinal slots 142 and 144 are formed in spaced-apart relationship about the inside diameter of friction rings 66 and 68. The slots are open in the radially inwardly direction and are sized to slidably engage with associated lugs or drive pins 146 and 148 extending radially outwardly from the frustoconical portions of mandrels 70 and 72.

The first overrunning roller locking clutch assembly 76 is pressed within the inside diameter of mandrel 70 and is engaged over the cylindrical left portion of input brake drive shaft 78 to permit the brake shaft to rotate counterclockwise relative to the mandrel as viewed from the left in FIG. 2 while locking the input brake drive shaft 78 to the mandrel 70 when rotating in the opposite relative direction. The second overrunning roller locking clutch assembly 80 is pressed within the inside diameter of mandrel 72 and is engaged over the cylindrical right portion of output brake drive shaft 82 to permit the output brake drive shaft 82 to rotate counterclockwise relative to the mandrel 72 as viewed from the left in FIG. 2 while locking the output brake drive shaft 82 to the mandrel 72 when rotating in the opposite relative direction. Overrunning roller locking clutch assemblies, such as 76 and 80 are well known in the art and are commercially available.

In the operation of brake assembly 24, when reversible motor 20 is operated to power output shaft 52 in the counterclockwise direction, as viewed from the left in FIG. 2, to reel in a load attached to the cable, the torque from the motor is transmitted by input drive shaft 26 to input brake drive shaft 78 then to input cam member 86 then to output cam member 88 then to output brake shaft 82 then to output drive shaft 28 and then to drum 12 through gear train 30. This torque load causes cam surfaces 94 of input cam member 86 to slide up or ramp up on cam surfaces 122 of output cam member 88, thereby shifting input cam member 86 and output cam member 88 away from each other. Input cam member 86 acts through thrust bushing 102, thrust bearing 104, thrust bushing 106, and thrust plate 108 to push friction ring 66 against mandrel 70, thereby causing friction ring 66 to expand and press tightly against the inside diameter of drum spool 32. At the same time, output cam member 88 acts through thrust bushing 130, thrust bearing 132, thrust bushing 134, and thrust plate 136 to squeeze or push friction ring 68 against mandrel 72, thereby causing friction ring 68 to expand and press tightly against the inside diameter of drum spool 32. The combined action of input cam member 86 and output cam member 88 thereby prevents relative rotation between brake-clutch assembly 24 and drum 12. However, overrunning clutch assemblies 76 and 80 permit input brake drive shaft 78, input cam member 86, output cam member 88, and output brake drive shaft 82 to rotate freely in the counterclockwise direction relative to mandrels 70 and 72 even though the mandrels and friction rings 66 and 68 are fixed relative to drum 12. As a result, the torque from motor 20 is transmitted through to output drive shaft 28 then to gear train 30 then to drum 12 where it rotates the drum in the reeling in direction, which is counterclockwise as viewed from the left in FIGS. 1 and 3.

If motor 20 is turned off or stopped when a load is attached to the cable, for instance while reeling in the cable, the brake-clutch assembly 24 locks drum 12 to prevent the cable from unwinding. The load on the cable imposes a reverse torque on drum 12 which is transmitted through gear train 30 to place a clockwise torque on output drive shaft 28 as viewed from the left in FIGS. 2 and 3. This reverse torque on output drive shaft 28 is in turn transmitted to output cam member 88 causing the cam surfaces 122 to slide up or ramp up cam surfaces 94, thereby shifting the two cam members axially apart. The cam members in turn simultaneously push friction rings 66 and 68 against mandrels 70 and 72 causing the friction rings to expand and lock against the inside diameter of drum spool 32. Because the overrunning clutch assembly 80 prevents clockwise rotation of the output brake drive shaft 82 relative to mandrel 72, the drum 12 is locked because output drive shaft 28 is locked.

When the rotational direction of motor 20 is reversed to reel out a load attached to the cable, input cam member 86 rotates clockwise relative to output cam member 88 causing the cam surfaces 94 to slide or ramp downwardly on cam surfaces 122 thereby removing the axial expansion force from brake-clutch assembly 24 and allowing friction rings 66 and 68 to contract slightly away from the inside diameter of spool 32 to again permit relative rotation between the brake-clutch assembly and the drum spool. This allows output brake drive shaft 82 and output drive shaft 28 to rotate in the clockwise direction as viewed from the left in FIG. 2 which in turn rotates drum 12 in the clockwise or reeling out direction. When output brake drive shaft 82 is rotated in the clockwise direction, it locks with mandrel 72 through overrunning clutch 80 so that brake-clutch assembly 24 rotates at the same speed as motor 20.

If a substantial load is being carried by the cable while it is being reeled out by winch 10, the load on the cable applies a reverse torque on drum 12 tending to cause the drum to rotate faster than its normal rotating speed when driven by motor 20 alone. This reverse torque is transmitted back through gear train 30 to output drive shaft 28. If the reverse torque on output drive shaft 28 exceeds the magnitude of the torque applied to the input drive shaft 26 by the clockwise rotation of motor 20, the resulting relative torque transmitted between the input drive shaft 26 and the output drive shaft 28 causes output cam member 88 to rotate clockwise relative to input cam member 86. As a result, cam surfaces 122 ramp up on cam surfaces 94 causing the two cam members to spread apart axially and thereby expanding friction rings 66 and 68 by forcing them against mandrels 70 and 72. As the friction rings expand, they frictionally rub against the inside diameter of spool 32 to impose a relative drag load between output drive shaft 28 and drum 12 thereby moderating the speed of the drum to prevent it from rotating any faster than its normal rotational speed when driven by motor 20.

It will be appreciated that when brake-clutch assembly 24 is functioning in this mode to control the speed of drum 12, large quantities of heat are generated by the rubbing of friction rings 66 and 68 against the inside diameter of spool 32. However, this heat is rapidly dissipated through the relatively large mass and large surface area of drum 12 and the cable. As a result, the temperature of friction rings 66 and 68 is maintained low enough to prevent a reduction in the coefficient of friction between the friction rings and the spool and to prevent damage to the friction rings, the spool, and the other components of winch 10.

The capacity of friction rings 66 and 68 to expand when forced against mandrels 70 and 72 may be altered by varying the number of longitudinal slots 142 and 144 formed in the inside diameter of the friction rings which affects the flexibility of the friction rings. Also the ability of the friction rings to expand automatically when initially contacting against the inside diameter of drum spool 32 is dependent upon the particular slot in which drive pins 146 and 148 are engaged. The closer that the particular slot which is engaged with drive pin 146 and 148 is located to the split in the ring, the less the rings tend to expand when initially contacting against the inside diameter of spool 32 and accordingly the smaller the self-energizing capacity of the friction rings. However, if drive pins 146 and 148 are engaged within slots located further away from the split, the increased circumferential distance between the engaged slots and the split increases the tendency of the frictions rings to expand when initially contacting the inside diameter of spool 32 thereby increasing the self-energizing capacity of the friction rings. In this manner, the sensitivity of brake-clutch assembly 24 may be selectively tuned to accommodate various factors, such as the capacity of winch 10, the size and rotational speed of motor 20, and the coefficient of friction between friction rings 66 and 68 and the inside diameter of spool 32. Thus, brake-clutch assembly 24 may be adjusted to smoothly engage with and disengage from drum 12, thereby avoiding unwanted vibration or chatter in the components of winch 10.

Preferably, friction rings 66 and 68 are constructed of reinforced plastic material, such as fiberglass-filled nylon 6/6. Nylon 6/6 is known in the plastics industry as a nylon which is filled with 40% by weight fiberglass and is commercially available. This type of material has sufficient elasticity to enable the friction rings to expand readily when forced against mandrels 70 and 72, while also having sufficient strength to safely carry the torque loads transmitted through winch 10.

As described above, reversible motor 20 drives drum 12 at reduced speed through brake-clutch assembly 24 and gear train 30. The gear train is disposed within a housing 22 mounted on right support structure 16. Preferably housing 22 is composed of an end housing 150 and a cylindrical section 152 disposed between the end housing 150 and the support structure 16. Gear train 30 includes first, second, and third stage planetary gear drive assemblies 154, 156, and 158, respectively, interconnected in torque transmitting relationship. The planetary gear assemblies efficiently reduce the speed of and multiply the torque produced by motor 20, thereby enabling winch 10 to handle heavy loads.

Figure 4:
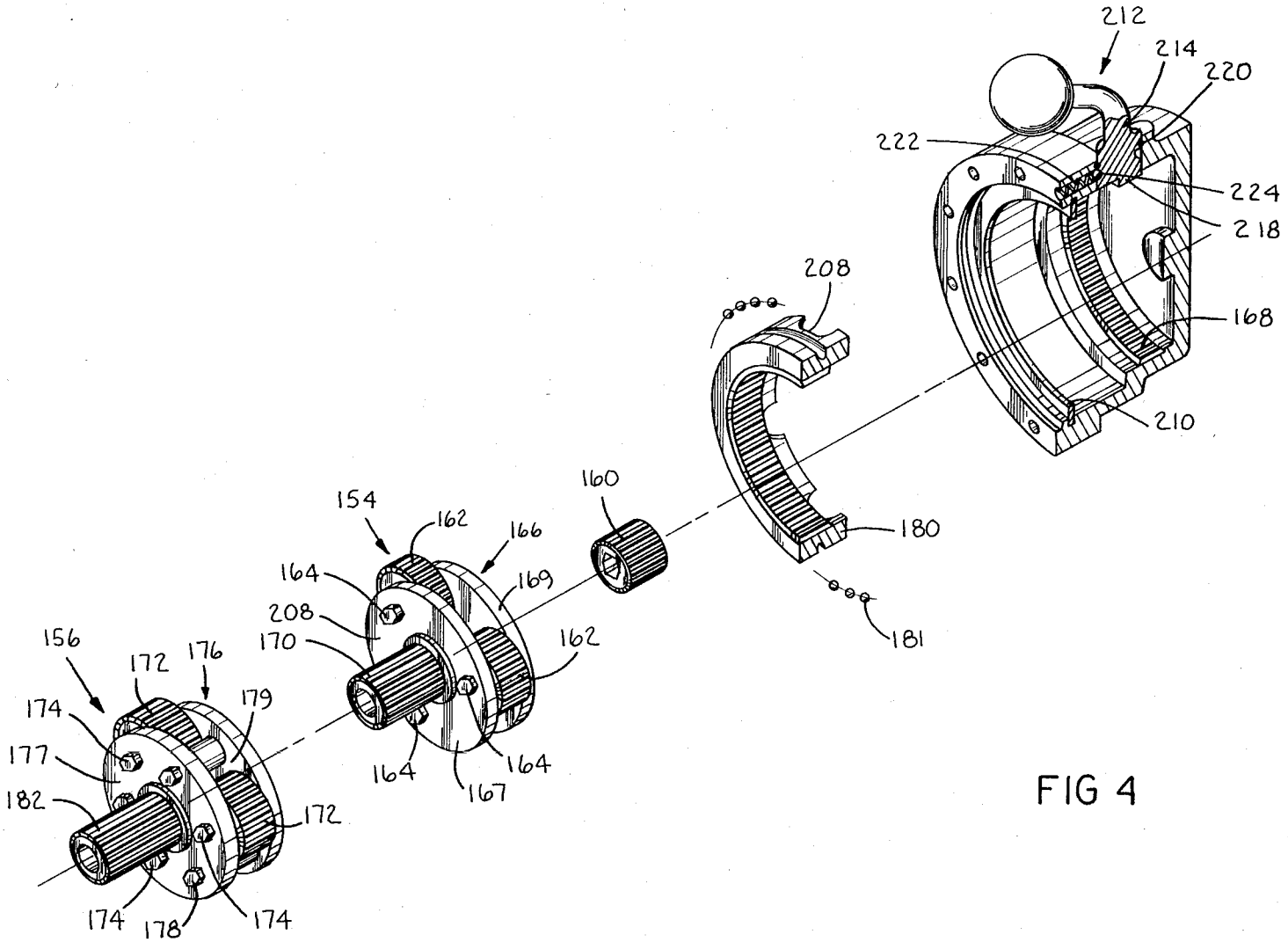
FIG. 4 is an isometric exploded view of the remainder of the gear train of the present invention taken from the left side of FIG. 1.

Gear train 30 includes the elongate output drive shaft 28 disposed coaxially along central axis 18. Preferably output drive shaft 28 is hexagonal in cross section to snugly engage within a correspondingly-shaped bore formed in the right hand end portion of output brake drive shaft 82. Output drive shaft 28 extends axially from output brake drive shaft 82 into the interior of gear train housing 22 to antirotationally engage with a sun gear 160 of the first stage planetary gear drive assembly 154 of gear train 30. As illustrated in FIG. 4, sun gear 160 is formed with a hexagonally-shaped axial bore for receiving the right end portion of output drive shaft 28.

Sun gear 160 meshes with the three pinion gears 162 which are rotatably mounted on pins 164 of a first stage planetary carrier assembly 166. Carrier assembly 166 is composed of two annularly-shaped carrier plates 167 and 169 which are spaced apart from each other in parallel relationship to receive pinion gears 162 therebetween. Pins 164 extend through aligned openings formed in the carrier plates. It will be appreciated that constructing carrier 166 with the plates 167 and 169 and pins 164 results in a lightweight but rigid structure for securely supporting pinion gears 162.

First stage pinion gears 162 mesh with a stationary circular ring gear 168 which is fixed in end housing 150 as illustrated in FIG. 4. Stationary ring gear 168 is disposed coaxially with rotational axis 18.

The second stage planetary gear drive assembly 156 is disposed alongside first stage planetary gear assembly 154 within end housing 150. The second stage planetary gear drive assembly 156 includes a sun gear 170 which is antirotationally fixed to carrier plate 167 of the first stage planetary gear drive assembly. A clearance opening extends through the center of sun gear 170 for free passage of output drive shaft 28. Sun gear 170 meshes with the three pinion gears 172 of the second stage planetary gear drive assembly 156 which are rotatably mounted on pins 174 of a second stage carrier assembly 176. As with first stage carrier assembly 166, second stage carrier assembly 176 is composed of a parallel pair of annularly-shaped carrier plates 177 and 179 disposed on opposite sides of pinion gears 172. Carrier plates 177 and 179 are held in spaced-apart relationship by pins 174 and pins 178. Second stage pinion gears 172 mesh with a cylindrical clutch-ring gear 180 disposed inside end housing 150. Second stage planetary drive 156 is positioned relative to first stage planetary drive 154 by abutment of the adjacent ends of first stage sun gear 160 with second stage sun gear 164.

Gear train 30 further includes the third stage planetary gear drive assembly 158 (FIG. 3) disposed alongside second stage planetary drive 156. The third stage planetary drive 158 includes a sun gear 182 (FIG. 4) which is antirotationally fixed to carrier plate 177 of the second stage planetary drive in a transverse direction from the second stage carrier assembly. An axial bore through sun gear 182 provides free passage for output drive shaft 28.

Sun gear 182 meshes with the three pinion gears 184 (FIG. 3) which are rotatably mounted on pins 186 of a third stage carrier assembly 188. Bushings 190 are pressed within the central bores formed in pinion gears 184 to antifrictionally journal the pinion gears on pins 186. Preferably bushings 190 are constructed from a self-lubricating material having a low coefficient of friction, such as bronze. The carrier plates 189 and 191 are fixed in spaced apart parallel relationship by spacer members 192. Pins 186 have reduced diameter shoulders at each end which engage through aligned holes formed in the two carrier plates. Preferably the ends of pins 186 are staked or otherwise secured to the carrier plates 189 and 191.

Third stage pinion gears 184 mesh with a stationary ring gear 194 formed as an integral portion of cylindrical housing section 152. Cylindrical housing section 152 is held in proper alignment with right drum support structure 16 by engagement of the teeth of ring gear 194 with a thin external gear integrally formed in the adjacent end face of support structure 16. End housing 150 and cylindrical section 152 of housing 22 are secured to support structure 16 by series of elongate bolts 196 (FIG. 1) extending through clearance holes in a flanged portion of end housing 150. Bolts 196 also extend through aligned clearance holes formed in cylindrical portion 152 to engage with aligned threaded holes formed in support structure 16.

Preferably the components of first, second, and third stage planetary drives 154, 156, and 158 are sized to produce a 6:1 speed reduction each for a total speed reduction of 216:1. The size of pinion gears 162, 172, and 184 progressively increase to reflect the fact that the first, second and third stage planetary drive assemblies progressively carry an increased torque load.

Third stage planetary gear drive assembly 158 is interconnected in torque transmitting relationship with drum 12 by a double connection gear 198 composed of a first gear portion 200 which meshes with an internal gear 202 integrally formed in the central portion of third stage carrier plate 189. Connection gear 198 also includes a second gear portion 204 which meshes with the internal gear 118 fixedly disposed within the adjacent end portion of drum spool 32. A thrust ring 206 is disposed within a groove formed in the periphery of connection gear 198, between first gear portion 200 and second gear portion 204, to longitudinally restrain the connection gear 198 and maintain it in meshing relationship with internal gears 118 and 202. An axial clearance opening extends through connection gear 198 to permit free passage of output drive shaft 28.

Clutch-ring gear 180 is held within the inside diameter of end housing 150 by retaining ring 210 and is supported on ball bearings 181 for selective engagement with and disengagement from manually operable clutch lever 212. As shown in FIGS. 1 and 4, clutch lever 212 includes a cylindrical hub portion 214 which rotatably engages within a close fitting circular bore extending radially through end housing 150. Clutch lever 212 further includes a curved handle 216 extending away from the top of hub portion 214. A half-moon eccentric stud member 218 extends downwardly from the bottom of hub portion 214 to engage with or disengage from arch-shaped peripheral notches 208 formed in the right edge portion of clutch-ring gear 180. A resilient O-ring seal 220 is disposed in a circumferential groove formed in the hub portion 214.

Clutch lever 212 is rotatable between a first angular (freespool) position shown in FIGS. 1 and 4 wherein eccentric stud member 218 is out of engagement with the peripheral notches 208 of clutch-ring gear 180 and a second angular (engaged) position 180° away from the first position wherein stud member 218 engages a peripheral notch 208 of clutch-ring gear 180. A ball 224 rides in a circumferential groove in hub portion 214 and is compressed by spring 222 to act as a detent when ball 224 seats in either of two depressions which mark the freespool position and the engaged position for clutch lever 212.

When clutch lever 212 is disposed in the freespool position shown in FIGS. 1 and 4, clutch-ring gear 180 is allowed to rotate or freewheel, thereby deactivating second stage planetary gear drive assembly 156. Specifically, when clutch-ring gear 180 is allowed to rotate, second stage pinion gears 172 roll around second stage sun gear 170 without driving it.

When clutch lever 212 is disposed in the engaged position, clutch-ring gear 180 is held stationary and cannot rotate because the presence of stud member 218 in a peripheral notch 208 prevents such rotation. When clutch-ring gear 180 is stationary, second stage pinion gears 172 will drive second stage sun gear 170 and vice versa. Accordingly, when clutch lever 212 is in the engaged position, torque from output drive shaft 28 will be transmitted through the gear train 30 to rotate drum 12, and likewise, reverse torque from drum 12 will be transmitted through the gear train 30 to output drive shaft 28.

It will be appreciated that the above-described construction of planetary drives 154, 156, and 158 results in a compact gear train 30 which efficiently reduces the speed of and increases the torque from output drive shaft 28 in order to power drum 12. Also, winch 10 may be conveniently manually shifted between a free spool mode and a power-transmitting mode by simply rotating clutch lever 212. In the free spool mode, the cable may be manually and quickly unwound from drum 12, for instance, when desiring to attach the end of the cable to a tree or some other object located at a distance from winch 10. When the winch is shifted to its free spool mode by rotating clutch lever 212 to the position shown in FIG. 1, clutch-ring gear 180 is disengaged so that second stage planetary drive 156 does not transmit reverse torque to output drive shaft 28. However, a certain amount of drag force is applied to drum 12 by third stage and second stage planetary drive assemblies 158 and 156 which are rotated by the drum when the cable is being reeled out. As a consequence, the drum will not continue to spin after the pull on the cable has been terminated, thus avoiding tangling of the cable.

As will be apparent to those skilled in the art to which the invention is addressed, the present invention may be embodied in forms other than those specifically disclosed above, without departing from the spirit or essential characteristics of the invention. The particular embodiment of winch 10 described above is therefore to be considered in all respects as illustrative and not restrictive. The scope of the present invention is as set forth in the appended claims rather than being limited to the example of the winch 10 set forth in the foregoing description. Any and all equivalents are intended to be embraced by the claims.

What is claimed is:

1. A winch comprising:

(a) a hollow cable winding drum rotatable about a longitudinal axis;

(b) a reversible motor means disposed longitudinally of a first end of said drum, said motor means including a first drive shaft means extending axially within said hollow drum;

(c) a power transmitting means operably connected to said drum and disposed longitudinally of an opposite, second end of said drum, said power transmitting means including a second drive shaft means extending axially within said hollow drum toward said first end of said drum;

(d) brake-clutch means disposed within said drum for drivingly interconnecting said first drive shaft means with said second drive shaft means, said brake-clutch means comprising:

(1) first brake means and second brake means for automatically frictionally engaging directly against the inside of said hollow drum when the direction of the torque load transmitted between said first drive shaft means and said second drive shaft means is in a first direction and automatically disengaging from the inside of said hollow drum when the direction of the torque load transmitted between said first drive shaft means and said second drive shaft means is in the opposite direction;

(2) a first overrunning clutch means disposed between said first drive shaft means and said first brake means permitting relative rotation between said first drive shaft means and said first brake means in a first direction but preventing relative rotation between said first drive shaft means and said first brake means in the opposite direction; and (3) a second overrunning clutch means disposed between said second drive shaft means and said second brake means permitting relative rotation between said second drive shaft means and said second brake means in said first direction but preventing relative rotation between said second drive shaft means and said second brake means in said opposite direction;

(e) said first brake means comprising a first friction ring assembly, said first friction ring assembly including a frustoconically-shaped mandrel coupled to said first overrunning clutch means, a first correspondingly-shaped frustoconical expandable friction ring antirotationally coupled to said first mandrel, and means for antirotationally coupling said first friction ring to said first mandrel to prohibit relative rotation while allowing relative longitudinal movement between said first friction ring and said first mandrel;

(f) said second brake means comprising a second friction ring assembly, said second friction ring assembly including a second frustoconically-shaped mandrel coupled to said second overrunning clutch means, a second correspondingly-shaped frustoconical expandable friction ring antirotationally coupled to said second mandrel, and means for antirotationally coupling said second friction ring to said second mandrel to prohibit relative rotation while allowing relative longitudinal movement between said second friction ring and said second mandrel;

(g) brake actuator means automatically responsive to the direction of the torque load transmitted between said first drive shaft means and said second drive shaft means to expand said first and second friction rings against the inside diameter of said hollow drum when the direction of the torque load transmitted between said first drive shaft means and said second drive shaft means is in a first direction and to contract said first and second friction rings away from the inside diameter of said hollow drum when the direction of the torque load transmitted between said first drive shaft means and said second drive shaft means is in the opposite direction; and (h) said brake actuator means comprising a first cam member antirotationally coupled with said first drive shaft means, said first cam member having an axially-facing cam surface, and a second cam member antirotationally coupled with said second drive shaft means, said second cam member having a corresponding axially-facing cam surface, said first cam member coacting with said second cam member as follows:

(1) to move said first cam member axially toward said first-friction ring assembly and to move said second cam member axially toward said second friction ring assembly wnen th torque load being transmitted between said first and second drive shaft means is in said first direction to thereby urge said first and second friction rings against said first and second mandrels, respectively, to expand said friction rings against the inside diameter of said hollow drum; and (2) to move said first cam member axially away from said first friction ring assembly and to move said second cam member axially away from said second friction ring assembly when the torque load being transmitted between said first and second drive shaft means is in the opposite direction to allow said first and second friction rings to shift axially away from said first and second mandrels to thereby enable said friction rings to contract away from the inside diameter of said hollow drum.

2. The winch according to claim 1, wherein:

each of said friction rings includes a plurality of axially disposed grooves spaced apart around the inside diameter of each of said rings; and said means for antirotationally coupling said friction rings to said mandrels comprises lug means projecting radially outwardly from said mandrels to engage in one of said grooves of each of said friction rings thereby to antirotationally couple said mandrels with said friction rings while permitting said mandrels and said friction rings to slide longitudinally relative to each other, with the engagement of said lug means within a particular friction ring groove varying the ability of said friction rings to expand automatically against the inside diameter of said hollow drum.

3. The winch according to claim 2, wherein said friction rings are composed of nylon and fiberglass materials.

4. The winch according to claim 3, wherein approximately 40% by weight of the rings is fiberglass.

5. A winch comprising:

(a) a hollow cable winding drum rotatable about a longitudinal axis;

(b) reversible motor means disposed longitudinally of a first end of said drum, said motor means including a first drive shaft means extending axially within said hollow drum;

(c) power transmission means operably connected to said drum and disposed longitudinally of an opposite, second end of said drum, said power transmission means including a second drive shaft means extending axially within said hollow drum toward said first end of said hollow drum;

(d) brake-clutch means disposed within said hollow drum for drivingly interconnecting said first drive shaft means with said second drive shaft means, said brake-clutch means comprising:

(1) first brake means and second brake means for automatically frictionally engaging directly against the inside diameter of said hollow drum when the direction of the torque load transmitted between said first drive shaft means and said second drive shaft means is in a first direction and automatically disengaging from the inside of said hollow drum when the direction of the torque load transmitted between said first drive shaft means and said second drive shaft means is in the opposite direction;

(2) a first overrunning clutch means disposed between said first drive shaft means and said first brake means permitting relative rotation between said first drive shaft means and said first brake means in a first direction and preventing relative rotation between said first drive shaft means and said first brake means in the opposite direction; and (3) a second overrunning clutch means disposed between said second drive shaft means and said second brake means permitting relative rotation between said second drive shaft means and said second brake means in said first direction and preventing relative rotation between said second drive shaft means and said second brake means in said opposite direction;

(e) said first brake means comprising a first friction ring assembly, said first friction ring assembly including a first frustoconically-shaped mandrel coupled to said first overrunning clutch means, a first correspondingly-shaped frustoconical expandable friction ring antirotationally coupled to said first mandrel, and means for antirotationally coupling said first friction ring to said first mandrel to prohibit relative rotation while allowing relative longitudinal movement between said first friction ring and said first mandrel;

(f) said second brake means comprising a second friction ring assembly, said second friction ring assembly including a second frustoconically-shaped mandrel coupled to said second overrunning clutch means, a second correspondingly-shaped frustoconical expandable friction ring antirotationally coupled to said second mandrel, and means for antirotationally coupling said second friction ring to said second mandrel to prohibit relative rotation while allowing relative longitudinal movement between said second friction ring and said second mandrel;

(g) brake actuator means automatically responsive to the direction of the torque load transmitted between said first drive shaft means and said second drive shaft means to expand said first and second friction rings against the inside diameter of said hollow drum and for contracting said friction rings away from the inside diameter of said hollow drum when the direction of the torque load transmitted between said first drive shaft means and said second drive shaft means is in the opposite direction;

(h) said brake actuator means comprising a first cam member antirotationally coupled with said first drive shaft means, said first cam member having an axially-facing cam surface, and a second cam member antirotationally coupled with said second drive shaft means, said second cam member having a corresponding axially-facing cam surface, said first cam member coacting with said second cam member as follows:

(1) to move said first cam member axially toward said first friction ring assembly and to move said second cam member axially toward said second friction ring assembly when the torque load being transmitted between said first and second drive shaft means is in said first direction to thereby urge said first and second friction rings against said first and second mandrels, respectively, to expand said friction rings against the inside diameter of said hollow drum; and (2) to move said first cam member axially away from said first friction ring assembly and to move said second cam member axially away from said second friction ring assembly when the torque load being transmitted between said first and second drive shaft means is in the opposite direction to allow said first and second friction rings to shift axially away from said first and second mandrels to thereby enable said first and second friction rings, respectively, to contract away from the inside diameter of said hollow drum;

(i) a first support structure rotatably supporting the first end portion of said drum, and a second support structure rotatably supporting the opposite, second end portion of said drum;

(j) a housing mounted on said second support structure to encase portions of said power transmission means; and (k) wherein said power transmission means comprises: (1) at least one planetary drive means disposed within said housing, said planetary drive means including a clutch-ring gear; and (2) coupling means rotatable about an axis transverse to said first and second drive shaft means for selectively antirotationally coupling and rotationally decoupling said clutch-ring gear to said housing to interconnect said drum to said power transmission means and to disconnected said drum from said power transmission means, respectively.

6. The winch according to claim 5, wherein said housing includes retaining means for preventing said ring gear from moving axially relative to said housing and said coupling means includes stud means for selectively engaging with and disengaging from peripheral notches in said ring gear.

7. The winch according to claim 5, wherein said power transmission means includes a first stage planetary drive means and a second stage planetary drive means coupled together in power transmission relationship and disposed together within said housing, said second stage planetary drive means including a ring gear selectively antirotationally coupleable with and rotationally decoupleable from said housing.

8. The winch according to claim 7, further including a third stage planetary drive means coupled between said second stage planetary drive means and said drum, said third stage planetary drive means including a ring gear disposed stationarily relative to said housing.

9. The winch according to claim 8, wherein said ring gear in said third stage planetary drive means forms a portion of said housing.

10. The winch according to claim 5, wherein said first and second drum support structures are substantially identical in shape.

* * * * *